US008106596B2

(12) United States Patent
Chang et al.

(10) Patent No.: US 8,106,596 B2
(45) Date of Patent: Jan. 31, 2012

(54) LIGHT SOURCE DRIVING CIRCUIT

(75) Inventors: Shih-Hsien Chang, Taoyuan Hsien (TW); Ming-Chih Hsieh, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 427 days.

(21) Appl. No.: 12/485,496

(22) Filed: Jun. 16, 2009

(65) Prior Publication Data

US 2010/0164393 A1 Jul. 1, 2010

(30) Foreign Application Priority Data

Dec. 31, 2008 (TW) ..... 97151596 A

(51) Int. Cl.
*H05B 37/02* (2006.01)
*H05B 39/04* (2006.01)
*H05B 41/36* (2006.01)

(52) U.S. Cl. ..... 315/219; 315/209 R; 315/287; 315/291; 315/307

(58) Field of Classification Search ..... None
See application file for complete search history.

(56) References Cited

U.S. PATENT DOCUMENTS 5,030,887 A * 7/1991 Guisinger ..... 315/158
7,772,782 B2 * 8/2010 Chu et al. ..... 315/247
2008/0309244 A1 * 12/2008 Hsu ..... 315/219

* cited by examiner

*Primary Examiner* — Anh Tran
(74) *Attorney, Agent, or Firm* — Kirton & McConkie; Evan R. Witt

(57) ABSTRACT

A light source driving circuit includes a transformer, a switching circuit, a control circuit, a brightness adjusting circuit and an isolator circuit. The brightness adjusting circuit is connected to a secondary winding assembly of the transformer and the light-emitting element for detecting an output voltage and/or an output current and generating a control signal according to the brightness adjusting signal. The isolator circuit is used for isolating the primary winding assembly of the transformer from the brightness adjusting circuit. The isolator circuit generates a feedback current according to the control signal. According to the feedback current, the switching circuit is controlled by the control circuit. As a status of the brightness adjusting signal is changed, a status of the control signal is changed and a time period of changing the status of the control signal is longer than a time period of changing the status of the brightness adjusting signal.

19 Claims, 7 Drawing Sheets

LIGHT SOURCE DRIVING CIRCUIT

FIELD OF THE INVENTION

The present invention relates to a light source driving circuit, and more particularly to a light source driving circuit for enhancing safety and reducing light source scintillation when the light-emitting element is driven by the light source driving circuit.

BACKGROUND OF THE INVENTION

In recent years, cold cathode fluorescent lamps (CCFLs) and light emitting diodes (LEDs) have been widely used. In comparison with the common incandescent lamps, LEDs or CCFLs have an increased illuminating efficiency and an extended service life. With the maturity of the LED and CCFL technology, LEDs or CCFLs will replace all conventional lighting facilities. Until now, LEDs or CCFLs are widely used in many aspects of daily lives, such as household lighting device, automobile lighting devices, handheld lighting devices, backlight sources for LCD panels, traffic lights, indicator board displays, and the like.

Generally, the cold cathode fluorescent lamp or the light emitting diode is driven to illuminate by a light source driving circuit. In addition, the brightness value of the cold cathode fluorescent lamp or the light emitting diode is controlled by the light source driving circuit. Based on the persistence of vision, the cold cathode fluorescent lamp or the light emitting diode is alternately turned on and turned off so as to intermittently emit light under the circumstance imperceptible to the human beings.

The conventional light source driving circuit includes a control circuit, a transformer and a switching circuit. The control circuit generates a control signal. According to the control signal, the switching circuit is alternately conducted or shut off. As such, the utility power received by the primary winding assembly of the transformer is converted into a regulated voltage, which is transmitted from the secondary winding assembly of the transformer to the cold cathode fluorescent lamp or the light emitting diode. Moreover, according to a brightness adjusting signal, the control circuit will control the duty cycle or the switching frequency of the switching circuit. Generally, the brightness adjusting signal includes alternate enabling signal and disabling signal. In response to the enabling signal, the cold cathode fluorescent lamp or the light emitting diode illuminates. In response to the disabling signal, the cold cathode fluorescent lamp or the light emitting diode is turned off. As the duty cycle or the switching frequency of the switching circuit is changed, the regulated voltage transmitted from the secondary winding assembly of the transformer is altered. As the regulated voltage transmitted from the secondary winding assembly of the transformer is altered, the time period of turning on or turning off the cold cathode fluorescent lamp or the light emitting diode will be increased or decreased. According to the brightness adjusting signal, the brightness value of the cold cathode fluorescent lamp or the light emitting diode is adjustable.

Since the control circuit of the conventional light source driving circuit is connected to the utility power through the primary winding assembly of the transformer and the brightness adjusting signal is directly transmitted to the control circuit, the user has a risk of getting an electric shock during the process of operating the brightness adjusting signal. In other words, the electrical safety of the conventional light source driving circuit is unsatisfactory.

Moreover, since the time period of switching the brightness adjusting signal from the enabling signal to the disabling signal or the time period of switching the brightness adjusting signal from the disabling signal to the enabling signal is very short, a problem of causing light source scintillation will occur when the cold cathode fluorescent lamp or the light emitting diode is driven by the conventional light source driving circuit.

There is a need of providing a light source driving circuit to obviate the drawbacks encountered from the prior art.

SUMMARY OF THE INVENTION

It is an object of the present invention to provide a light source driving circuit having enhanced electrical safety and reduced light source scintillation when the light-emitting element is driven by the light source driving circuit.

In accordance with an aspect of the present invention, there is provided a light source driving circuit for driving at least one light-emitting element and controlling a brightness value of the light-emitting element according to a brightness adjusting signal. The light source driving circuit includes a transformer, a switching circuit, a control circuit, a brightness adjusting circuit and an isolator circuit. The transformer includes a primary winding assembly and a secondary winding assembly. The secondary winding assembly is electrically connected to the light-emitting element. The switching circuit is electrically connected to the primary winding assembly of the transformer. A control circuit is electrically connected to the switching circuit. The brightness adjusting circuit is electrically connected to the secondary winding assembly of the transformer and the light-emitting element for detecting an output voltage and/or an output current outputted from the secondary winding assembly and generating a control signal according to the brightness adjusting signal. The isolator circuit is electrically connected to the brightness adjusting circuit and the control circuit for isolating the primary winding assembly of the transformer from the brightness adjusting circuit. The isolator circuit generates a feedback current according to the control signal. The switching circuit is controlled by the control circuit according to the feedback current. As a status of the brightness adjusting signal is changed, a status of the control signal is changed and a time period of changing the status of the control signal is longer than a time period of changing the status of the brightness adjusting signal.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
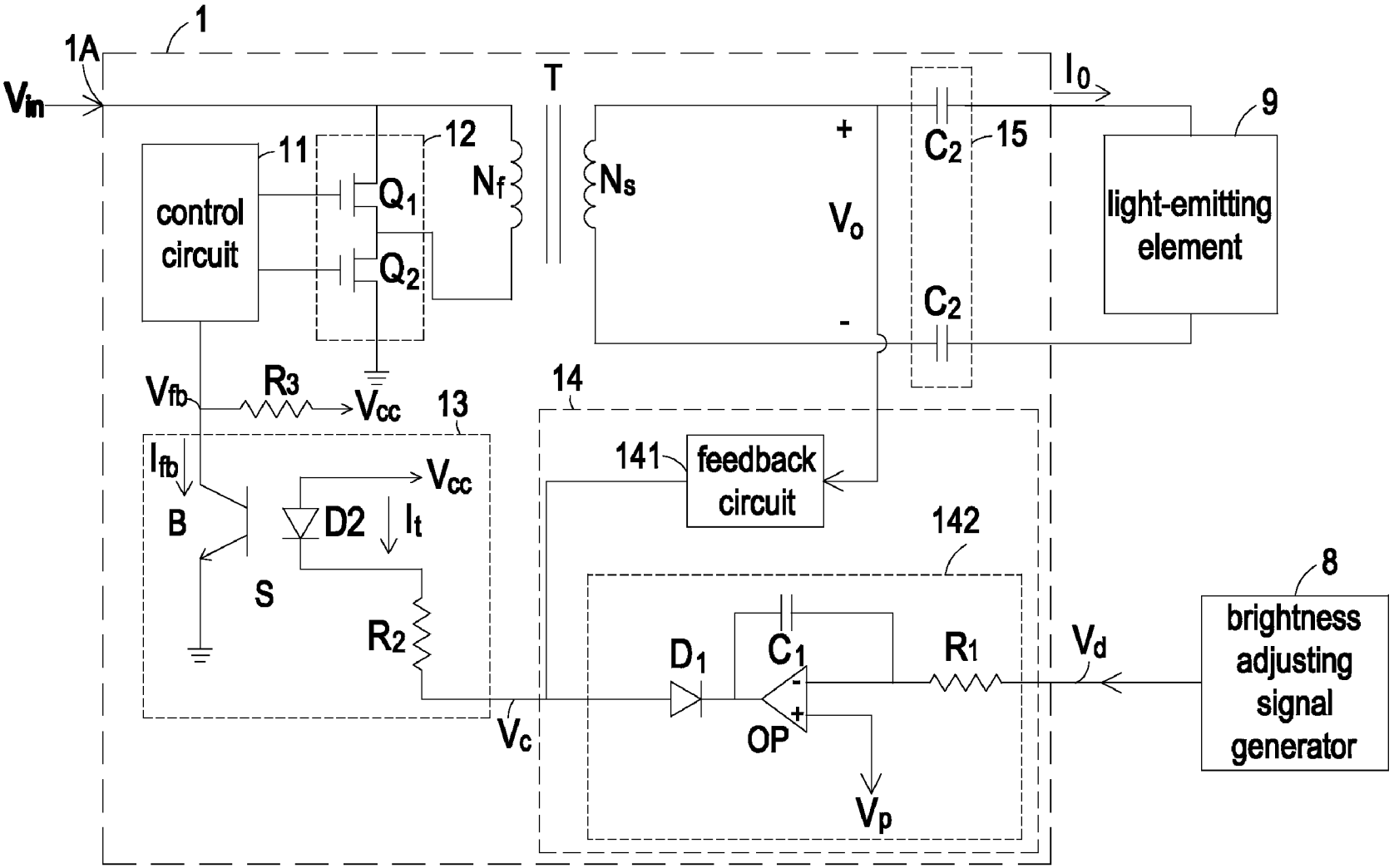
FIG. 1 is a schematic circuit diagram of a light source driving circuit according to a first embodiment of the present invention.

FIG. 1 is a schematic circuit diagram of a light source driving circuit according to a first embodiment of the present invention. As shown in FIG. 1, the light source driving circuit 1 is electrically connected to at least a light-emitting element 9. An example of the light-emitting element 9 includes a cold cathode fluorescent lamp (CCFL) or a light emitting diode (LED). An input voltage $V_{in}$ (e.g. utility power) is converted by the light source driving circuit 1 into an output voltage $V_o$ required for illuminating the light-emitting element 9. Furthermore, the light source driving circuit 1 is electrically connected to a brightness adjusting signal generator 8. The brightness adjusting signal generator 8 is used for generating a brightness adjusting signal $V_d$. According to the brightness adjusting signal $V_d$, the light source driving circuit 1 can adjust the brightness value of the light emitted by the light-emitting element 9. The brightness adjusting signal $V_d$ includes alternate enabling signal and disabling signal. In response to the enabling signal, the light-emitting element 9 illuminates. In response to the disabling signal, the light-emitting element 9 is turned off. As shown in FIG. 1, the light source driving circuit 1 principally comprises a control circuit 11, a switching circuit 12, an isolator circuit 13, a brightness adjusting circuit 14 and a transformer T. The primary winding assembly $N_f$ of the transformer T is connected to the input terminal 1A of the light source driving circuit 1. The input voltage $V_{in}$ is received by the primary winding assembly $N_f$ and then magnetically transmitted to the secondary winding assembly $N_s$ of the transformer T. As such, the secondary winding assembly $N_s$ generates the output voltage $V_o$.

The switching circuit 12 is connected to the control circuit 11, the primary winding assembly $N_f$, a common terminal and the input terminal 1A of the light source driving circuit 1. Under control of the control circuit 11, the switching circuit 12 is alternately conducted or shut off. The electric energy received by the primary winding assembly $N_f$ will be magnetically transmitted to the secondary winding assembly $N_s$ of the transformer T, and thus the secondary winding assembly $N_s$ generates the output voltage $V_o$.

In this embodiment, the switching circuit 12 includes a first switch $Q_1$ and a second switch $Q_2$. The first switch $Q_1$ is connected to the primary winding assembly $N_f$ of the transformer T, the second switch $Q_2$, the input terminal 1A of the light source driving circuit 1 and the control circuit 11. The second switch $Q_2$ is interconnected between the first switch $Q_1$ and the common terminal in series. The second switch $Q_2$ is also connected to the primary winding assembly $N_f$ of the transformer T and the control circuit 11. Under control of the control circuit 11, the first switch $Q_1$ and the second switch $Q_2$ are alternately conducted or shut off.

A first input terminal of the brightness adjusting circuit 14 is connected to the secondary winding assembly $N_s$ of the transformer T and the light-emitting element 9. A second input terminal of the brightness adjusting circuit 14 is connected to the brightness adjusting signal generator 8. An output terminal of the brightness adjusting circuit 14 is connected to the input terminal of the isolator circuit 13. The brightness adjusting circuit 14 is used for detecting the output voltage $V_o$ that is outputted from the secondary winding assembly $N_s$ of the transformer T. In addition, according to the brightness adjusting signal $V_d$, the brightness adjusting circuit 14 generates a control signal $V_c$. As the status of the brightness adjusting signal $V_d$ is switched from the enabling signal to the disabling signal or from the disabling signal to the enabling signal, the status of the control signal $V_c$ is altered. Under control of the brightness adjusting circuit 14, the time period of changing the status of the control signal $V_c$ is adjusted, and the time period of changing the status of the control signal $V_c$ is longer than the time period of changing the status of the brightness adjusting signal $V_d$.

In this embodiment, the brightness adjusting circuit 14 includes a feedback circuit 141 and a brightness adjusting signal converting circuit 142. The input terminal of the feedback circuit 141 is connected to the secondary winding assembly $N_s$ of the transformer T and the light-emitting element 9. The output terminal of the feedback circuit 141 is connected to the output terminal of the brightness adjusting circuit 14. The feedback circuit 141 is used for detecting the output voltage $V_o$ that is outputted from the secondary winding assembly $N_s$ of the transformer T. The input terminal of the brightness adjusting signal converting circuit 142 is connected to the brightness adjusting signal generator 8. The output terminal of the brightness adjusting signal converting circuit 142 is connected to the output terminal of the feedback circuit 141 and the output terminal of the brightness adjusting circuit 14. The brightness adjusting signal converting circuit 142 is used for receiving the brightness adjusting signal $V_d$ and increasing the time period of changing the status of the brightness adjusting signal $V_d$. According to the output voltage $V_o$ received by the feedback circuit 141 and the brightness adjusting signal $V_d$ received by the brightness adjusting signal converting circuit 142, the brightness adjusting circuit 14 generates the control signal $V_c$. By the brightness adjusting signal converting circuit 142, the time period of changing the status of the control signal $V_c$ is adjusted, and the time period of changing the status of the control signal $V_c$ is longer than the time period of changing the status of the brightness adjusting signal $V_d$.

The brightness adjusting signal converting circuit 142 comprises a signal amplifier OP, a first capacitor $C_1$, a first resistor $R_1$ and a first diode $D_1$. An end of the first resistor $R_1$ is connected to the brightness adjusting signal generator 8. The other end of the first resistor $R_1$ is connected to the negative terminal of the signal amplifier OP. The positive terminal of the signal amplifier OP receives a reference voltage $V_p$. The brightness adjusting signal $V_d$ is transmitted from the brightness adjusting signal generator 8 to the negative terminal of the signal amplifier OP through the first resistor $R_1$. The output terminal of the signal amplifier OP is connected to the cathode of the first diode $D_1$. The anode of the first diode $D_1$ is connected to the output terminal of the feedback circuit 141. An end of the first capacitor $C_1$ is connected to the first resistor $R_1$ and the negative terminal of the signal amplifier OP. The other end of the first capacitor $C_1$ is connected to the output terminal of the signal amplifier OP and the cathode of the first diode $D_1$.

The input terminal of the isolator circuit 13 is connected to the output terminal of the brightness adjusting circuit 14. The output terminal of the isolator circuit 13 is connected to the control circuit 11. The isolator circuit 13 is used for isolating the primary winding assembly $N_f$ of the transformer T from the brightness adjusting circuit 14. As a consequence, the safety of the light source driving circuit 1 is increased. By means of the isolator circuit 13, the user will not be directly contacted with the input voltage $V_{in}$ during the brightness adjusting signal $V_d$ is generated by the brightness adjusting signal generator 8.

In this embodiment, the isolator circuit 13 includes a photo coupler S and a second resistor $R_2$. The input terminal of the photo coupler S is connected to a light-emitting diode $D_2$. The light-emitting diode $D_2$ receives a source voltage $V_{cc}$ and is connected to an end of the second resistor $R_2$. The other end of the second resistor $R_2$ is connected to the output terminal of the brightness adjusting circuit 14 for receiving the control signal $V_c$ that is transmitted from the brightness adjusting circuit 14. According to the voltage difference between the source voltage $V_{cc}$ and the control signal $V_c$, the input terminal of the isolator circuit 13 generates a detecting current $I_t$. The current value of the detecting current $I_t$ is dependent on the voltage value change of the control signal $V_c$. The output terminal of the photo coupler S is connected to a photo transistor B. In other words, the photo transistor B is connected between the control circuit 11 and the common terminal in series. According to the detecting current $I_t$, the output terminal of the isolator circuit 13 generates a feedback current $I_{fb}$.

In this embodiment, the light source driving circuit 1 further includes a third resistor $R_3$. An end of the third resistor $R_3$ receives the source voltage $V_{cc}$. The other end of the third resistor $R_3$ is connected between the control circuit 11 and the isolator circuit 13. When the output terminal of the isolator circuit 13 generates the feedback current $I_{fb}$, a feedback voltage $V_{fb}$ is generated by the third resistor $R_3$.

The input terminal of the control circuit 11 is connected to the output terminal of the isolator circuit 13. The output terminal of the control circuit 11 is connected to the switching circuit 12. The control circuit 11 can generate for example a pulse width modulation signal. The switching circuit 12 is alternately conducted or shut off in response to the pulse width modulation signal. According to the feedback current $I_{fb}$ transmitted from the output terminal of the isolator circuit 13 and/or the feedback voltage $V_{fb}$ generated by the third resistor $R_3$, the duty cycle or the switching frequency of the switching circuit 12 is adjustable. In other words, as the feedback current $I_{fb}$ and/or the feedback voltage $V_{fb}$ is changed, the output voltage $V_o$ that is outputted from the secondary winding assembly $N_s$ of the transformer T is altered. According to the brightness adjusting signal $V_d$, the light source driving circuit 1 can control the brightness value of the light emitted by the light-emitting element 9.

Figure 2:
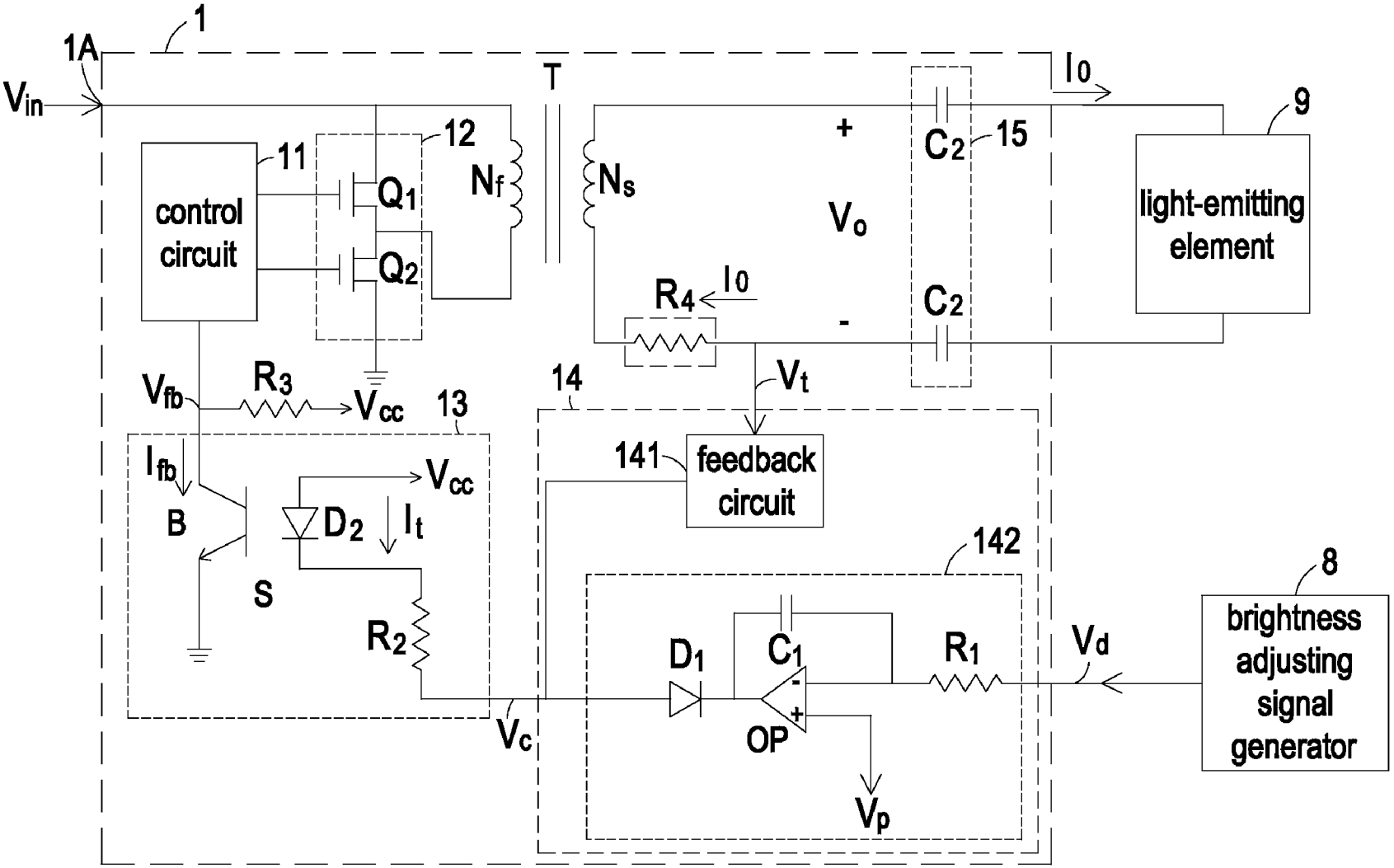
FIG. 2 is a schematic circuit diagram illustrating a variant of the light source driving circuit according to the first embodiment of the present invention.

In the above embodiment, the feedback circuit 141 can directly detect the output voltage $V_o$ that is outputted from the secondary winding assembly $N_s$ of the transformer T. FIG. 2 is a schematic circuit diagram illustrating a variant of the light source driving circuit according to the first embodiment of the present invention. In comparison with FIG. 1, the light source driving circuit 1 of FIG. 2 further includes a fourth resistor $R_4$. The fourth resistor $R_4$ is interconnected between the secondary winding assembly $N_s$ of the transformer T and the light-emitting element 9. In addition, the brightness adjusting circuit 14 is connected to the fourth resistor $R_4$ and the light-emitting element 9. When an output current $I_o$ generated by the secondary winding assembly $N_s$ of the transformer T flows through the fourth resistor $R_4$, the fourth resistor $R_4$ generates a corresponding detecting voltage $V_t$. According to the detecting voltage $V_t$, the brightness adjusting circuit 14 can indirectly detect the output voltage $V_o$.

Please refer to FIGS. 1 and 2. In these embodiments, the light source driving circuit 1 further includes a sharing circuit 15. The sharing circuit 15 is interconnected between the secondary winding assembly $N_s$ of the transformer T and every light-emitting element 9. In a case that the at least one light-emitting element 9 includes multiple light-emitting elements 9, the currents flowing into all of the multiple light-emitting elements 9 are equal by means of the sharing circuit 15. In some embodiments, the sharing circuit 15 includes at least a second capacitor $C_2$.

Figure 3:
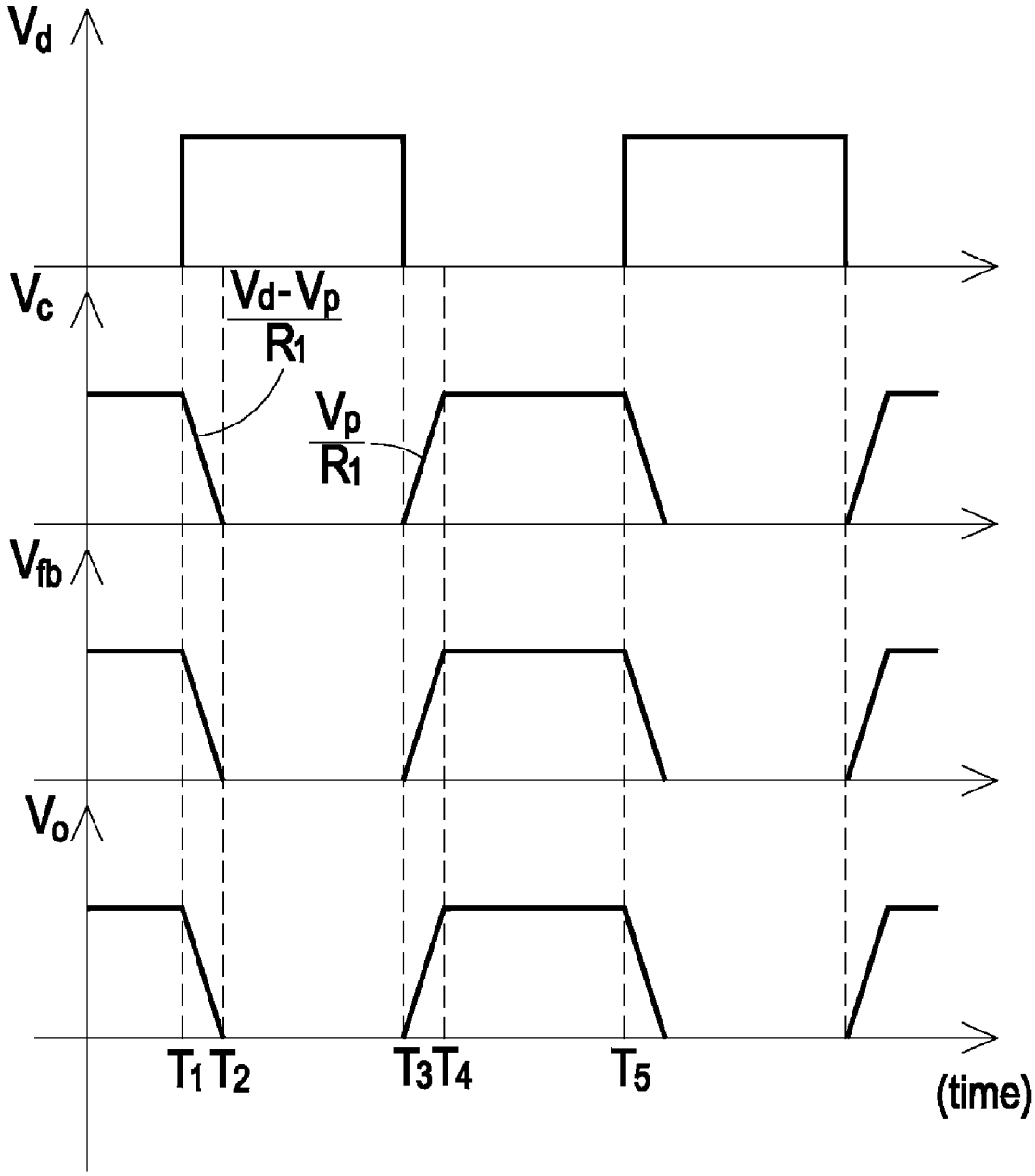
FIG. 3 is a timing waveform diagram schematically illustrating the corresponding voltage signals processed in the light source driving circuit of FIG. 1.

FIG. 3 is a timing waveform diagram schematically illustrating the corresponding voltage signals processed in the light source driving circuit of FIG. 1. Hereinafter, the principle of controlling the switching circuit 12 according to the feedback voltage $V_{fb}$ that is transmitted from the third resistor $R_3$ will be illustrated with FIGS. 1, 2 and 3. In accordance with a key feature of the present invention, whether the brightness adjusting signal $V_d$ is an enabling signal or a disabling signal is dependent on the illuminating status of the light-emitting element 9. In a case that the brightness adjusting signal $V_d$ is at a low-level status from $t=T_3$ to $T_5$ for example, a high-level output voltage $V_o$ is outputted from the light source driving circuit 1 to drive illumination of the light-emitting element 9. That is, the brightness adjusting signal $V_d$ at the low-level status indicates the enabling signal. Whereas, in a case that the brightness adjusting signal $V_d$ is at a high-level status from $t=T_1$ to $T_3$ for example, a low-level output voltage $V_o$ is outputted from the light source driving circuit 1 to turn off the light-emitting element 9. That is, the brightness adjusting signal $V_d$ at the high-level status indicates the disabling signal.

At $t=T_1$, the brightness adjusting signal $V_d$ is switched from a low-level status (i.e. an enabling signal) to a high-level status (i.e. a disabling signal). As shown in FIG. 3, the time period of changing the status of the brightness adjusting signal $V_d$ is very short. As the status of the brightness adjusting signal $V_d$ is changed, the control signal $V_c$ outputted from the brightness adjusting circuit 14 is altered. As shown in FIG. 3, the control signal $V_c$ is switched from the high-level status (at $t=T_1$) to the low-level status (at $t=T_2$). That is, from $t=T_1$ to $T_2$, the control signal $V_c$ is decreased at a rate of $(V_d-V_p)/R_1$, where $V_d$, $V_p$ and $R_1$ indicate the voltage value of the brightness adjusting signal $V_d$, the voltage value of the reference voltage $V_p$ and the resistance value of the first resistor $R_1$, respectively. Like the control signal $V_c$, the feedback voltage $V_{fb}$ and the output voltage $V_o$ are also decreased at a specified rate from $t=T_1$ to $T_2$. When the output voltage $V_o$ is at the low-level status, the light-emitting element 9 is turned off.

At $t=T_3$, the brightness adjusting signal $V_d$ is switched from a high-level status (i.e. a disabling signal) to a low-level status (i.e. an enabling signal). As shown in FIG. 3, the time period of changing the status of the brightness adjusting signal $V_d$ is also very short. As the status of the brightness adjusting signal $V_d$ is changed, the control signal $V_c$ outputted from the brightness adjusting circuit 14 is altered. As shown in FIG. 3, the control signal $V_c$ is switched from the low-level status (at $t=T_3$) to the high-level status (at $t=T_4$). That is, from $t=T_3$ to $T_4$, the control signal $V_c$ is increased at a rate of $V_p/R_1$, where $V_p$ and $R_1$ indicate the voltage value of the reference voltage $V_p$ and the resistance value of the first resistor $R_1$, respectively. Like the control signal $V_c$, the feedback voltage $V_{fb}$ and the output voltage $V_o$ are also increased at a specified rate from $t=T_3$ to $T_4$. When the output voltage $V_o$ is at the high-level status, the light-emitting element 9 illuminates.

Please refer to FIG. 3 again. The time period of switching the control signal $V_c$ from the high-level status to the low-level status is longer than the time period of switching the brightness adjusting signal $V_d$ from the enabling signal to the disabling signal. Similarly, the time period of switching the control signal $V_c$ from the low-level status to the high-level status is longer than the time period of switching the brightness adjusting signal $V_d$ from the disabling signal to the enabling signal. Similarly, the time period of switching the feedback voltage $V_{fb}$ or the output voltage $V_o$ from the low-level status to the high-level status or from the high-level status to the low-level status is longer than the time period of changing the status of the brightness adjusting signal $V_d$. When the light-emitting element 9 is driven to illuminate by the output voltage $V_o$ that is generated by the light source driving circuit 1, the light source scintillation is reduced because the time period of changing the status of the output voltage $V_o$ is increased.

When the brightness value of the light-emitting element 9 is adjusted by the light source driving circuit 1 according to the brightness adjusting signal $V_d$, the control circuit 11 of the light source driving circuit 1 is possibly affected by the external environment or the internal components and thus the control circuit 11 fails to precisely control operations of the switching circuit 12. Under this circumstance, the duration of illuminating the light-emitting element 9 is shorter than the duration of the enabling signal of the brightness adjusting signal $V_d$ and the light source driving circuit 1 fails to precisely control the brightness value of the light-emitting element 9. For compensating the adverse effect of the external environment or the internal components, the brightness adjusting circuit 14 of the light source driving circuit 1 further comprises a compensating circuit 16 (see FIG. 4).

Figure 4:
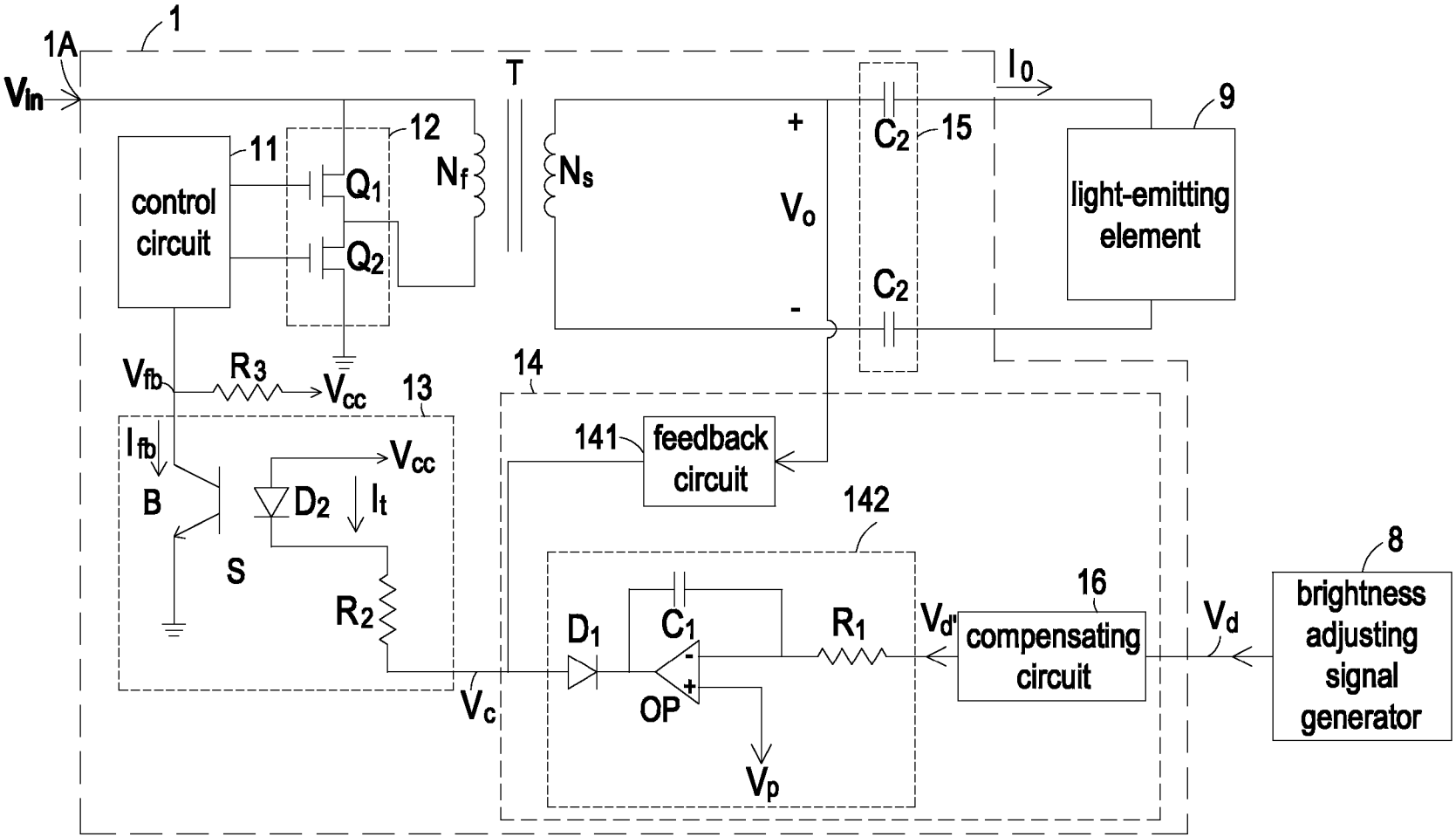
FIG. 4 is a schematic circuit diagram of a light source driving circuit according to a second embodiment of the present invention.

FIG. 4 is a schematic circuit diagram of a light source driving circuit according to a second embodiment of the present invention. As shown in FIG. 4, the brightness adjusting circuit 14 of the light source driving circuit 1 further comprises a compensating circuit 16. The input terminal of the compensating circuit 16 is connected to the brightness adjusting signal generator 8. The output terminal of the compensating circuit 16 is connected to the brightness adjusting signal converting circuit 142. The compensating circuit 16 is used for increasing the duration of the enabling signal of the brightness adjusting signal $V_d$, thereby generating a compensated brightness adjusting signal $V_{d'}$ to the brightness adjusting circuit 14. Under this circumstance, the brightness adjusting circuit 14 generates a control signal $V_c$ according to the compensated brightness adjusting signal $V_{d'}$ and the output voltage $V_o$. Even if the control circuit 11 fails to precisely control operations of the switching circuit 12 due to the adverse influence of the external environment or the internal components, the duration of the enabling signal of the brightness adjusting signal $V_d$ is increased. According to the compensated brightness adjusting signal $V_{d'}$, the brightness value of the light-emitting element 9 can be precisely adjusted by the light source driving circuit 1. As the status of the compensated brightness adjusting signal $V_{d'}$ is changed, the time period of changing the status of the control signal $V_c$ is longer than the time period of changing the status of the compensated brightness adjusting signal $V_{d'}$ by the brightness adjusting signal converting circuit 142. As a consequence, the light source scintillation is reduced when the light-emitting element 9 is driven to illuminate by the light source driving circuit 1.

Figure 5:
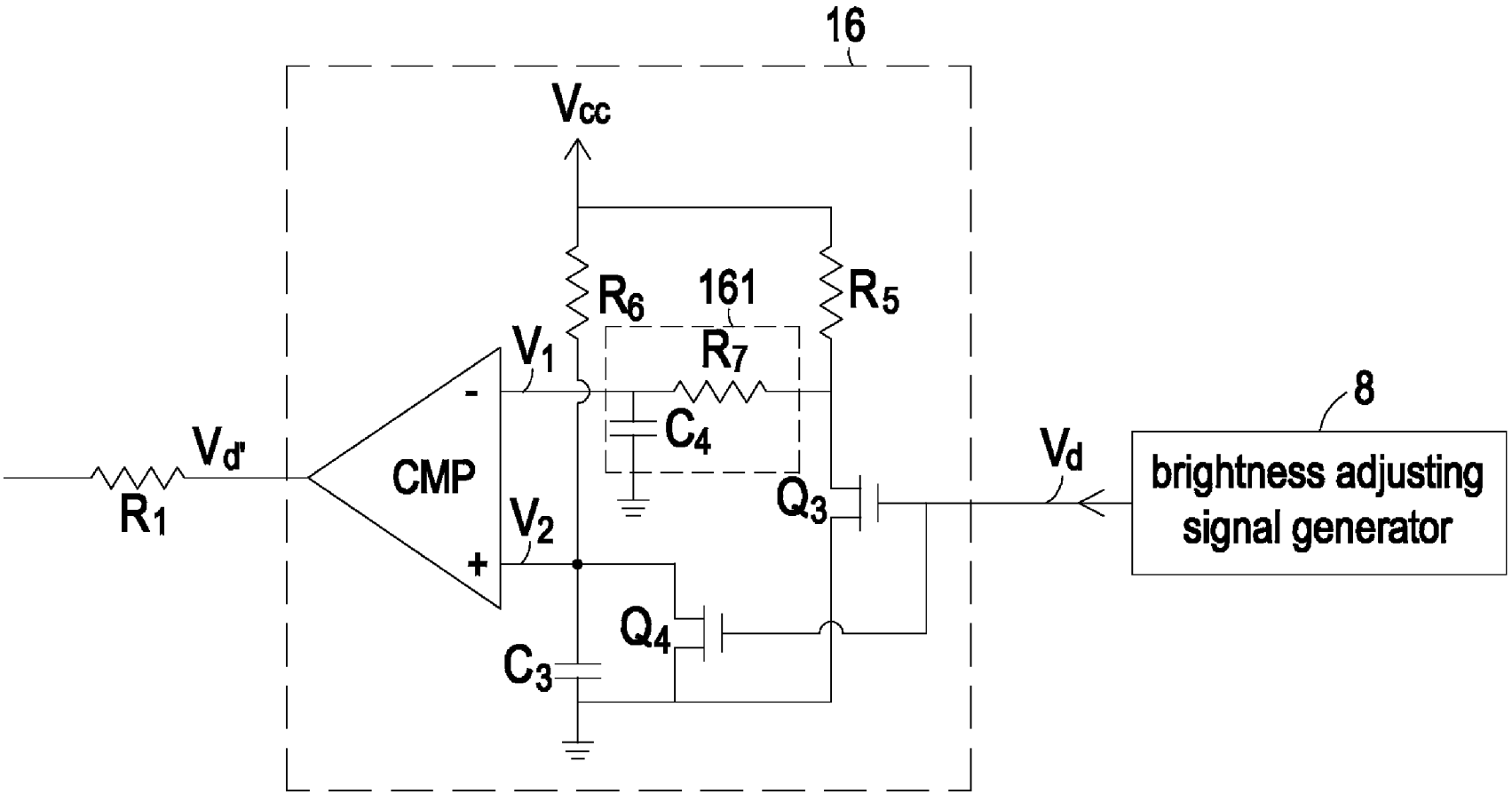
FIG. 5 is a schematic detailed circuit diagram of the compensating circuit of FIG. 4.

FIG. 5 is a schematic detailed circuit diagram of the compensating circuit of FIG. 4. The compensating circuit 16 includes a third switch $Q_3$, a fourth switch $Q_4$, a fifth resistor $R_5$, a sixth resistor $R_6$, a third capacitor $C_3$, a filtering circuit 161 and a comparator CMP. The third switch $Q_3$ is connected to the brightness adjusting signal generator 8, the fifth resistor $R_5$, the filtering circuit 161 and the common terminal. The fourth switch $Q_4$ is connected to the brightness adjusting signal generator 8, the third capacitor $C_3$, the positive terminal of the comparator CMP, the sixth resistor $R_6$ and the common terminal. According to the brightness adjusting signal $V_d$ transmitted from the brightness adjusting signal generator 8, the third switch $Q_3$ and the fourth switch $Q_4$ are simultaneously conducted or shut off.

The fifth resistor $R_5$ is connected to the third switch $Q_3$, the sixth resistor $R_6$ and the filtering circuit 161. The sixth resistor $R_6$ is connected to the third capacitor $C_3$, the fourth switch $Q_4$, the fifth resistor $R_5$ and the positive terminal of the comparator CMP. Both of the fifth resistor $R_5$ and the sixth resistor $R_6$ receive a source voltage $V_{cc}$.

The filtering circuit 161 is connected to the fifth resistor $R_5$, the third switch $Q_3$, the negative terminal of the comparator CMP and the common terminal. The source voltage $V_{cc}$ is transmitted to the filtering circuit 161 through the fifth resistor $R_5$. The source voltage $V_{cc}$ is filtered by the filtering circuit 161 and then transmitted to the negative terminal of the comparator CMP. In this embodiment, the filtering circuit 161 further includes a seventh resistor $R_7$ and a fourth capacitor $C_4$. The seventh resistor $R_7$ is connected to the fifth resistor $R_5$, the third switch $Q_3$, the negative terminal of the comparator CMP and the fourth capacitor $C_4$. The fourth capacitor $C_4$ is connected to the seventh resistor $R_7$, the negative terminal of the comparator CMP and the common terminal.

The third capacitor $C_3$ is connected to the positive terminal of the comparator CMP, the sixth resistor $R_6$, the fourth switch $Q_4$ and the common terminal. The output terminal of the comparator CMP is connected to the output terminal of the compensating circuit 16 and the first resistor $R_1$ of the brightness adjusting signal converting circuit 142. The negative terminal of the comparator CMP is connected to the filtering circuit 161. The positive terminal of the comparator CMP is connected to the sixth resistor $R_6$, the fourth switch $Q_4$ and the third capacitor $C_3$.

Figure 6:
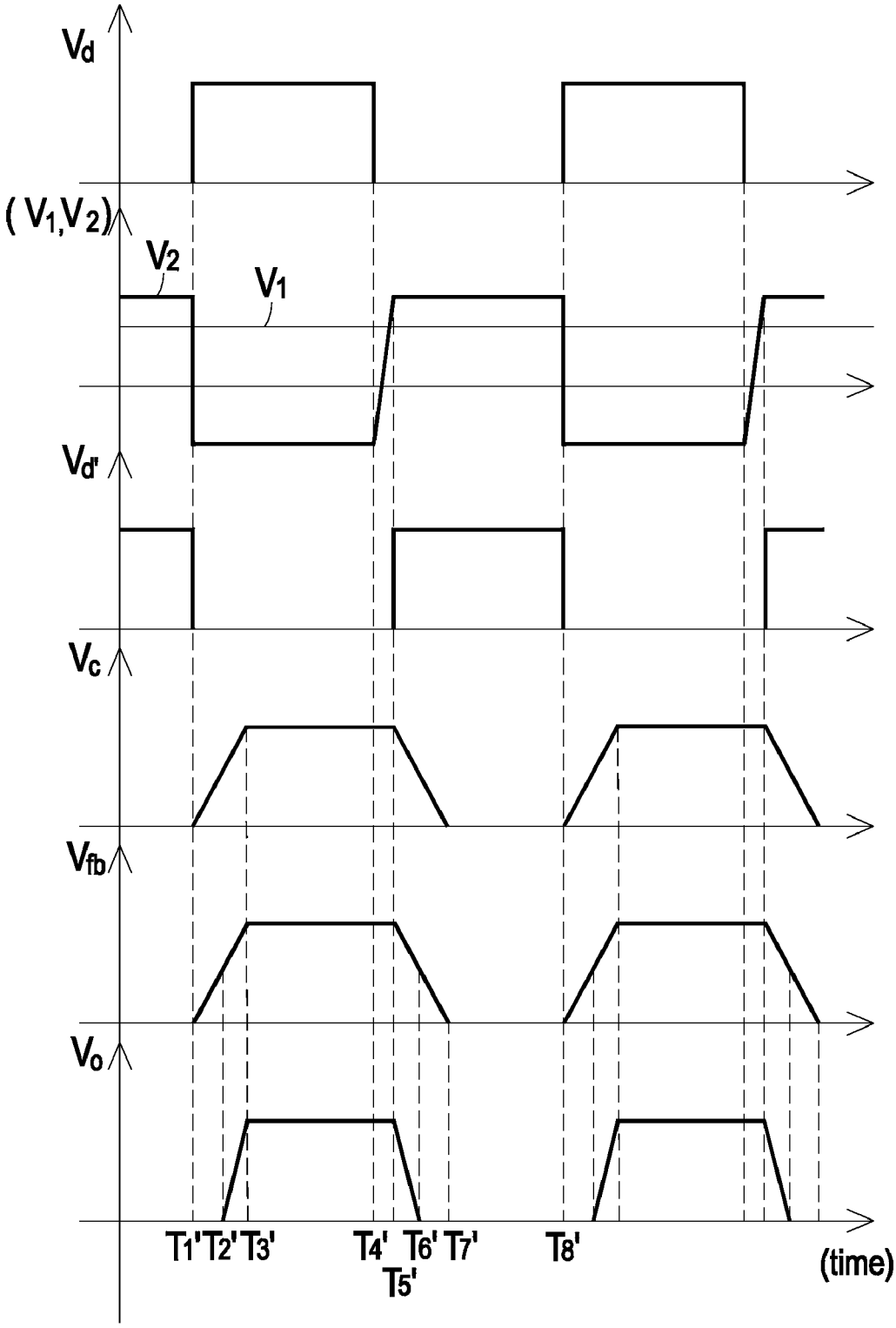
FIG. 6 is a timing waveform diagram schematically illustrating the corresponding voltage signals processed in the light source driving circuit of FIG. 4.

FIG. 6 is a timing waveform diagram schematically illustrating the corresponding voltage signals processed in the light source driving circuit of FIG. 4. Hereinafter, the operations of the light source driving circuit 1 having the compensating circuit 16 will be illustrated with reference to FIGS. 4, 5 and 6. It is assumed that the control circuit 11 of the light source driving circuit 1 is affected by the external environment or the internal components and fails to precisely control operations of the switching circuit 12. As shown in FIG. 5, a first voltage $V_1$ and a second voltage $V_2$ are respectively inputted into the negative terminal and the positive terminal of the comparator CMP. As shown in FIG. 6, the brightness adjusting signal $V_d$ is at a high-level status from $t=T_{1'}$ to $T_{4'}$ for example, the third switch $Q_3$ and the fourth switch $Q_4$ are simultaneously conducted. Meanwhile, the source voltage $V_{cc}$ is transmitted to the filtering circuit 161 through the fifth resistor $R_5$. The source voltage $V_{cc}$ is filtered by the filtering circuit 161 and then transmitted to the negative terminal of the comparator CMP. As such, the first voltage $V_1$ received by the negative terminal of the comparator CMP is maintained at a constant level. At the same time, the source voltage $V_{cc}$ is transmitted to the third capacitor $C_3$ through the sixth resistor $R_6$ so as to charge the third capacitor $C_3$. Since the fourth switch $Q_4$ is conducted, the second voltage $V_2$ received by the positive terminal of the comparator CMP is at a low-level status. Since the first voltage $V_1$ is greater than the second voltage $V_2$, the output terminal of the comparator CMP generates a low-level compensated brightness adjusting signal $V_{d''}$.

From $t=T_{4'}$ to $T_{8'}$ for example, the brightness adjusting signal $V_d$ is at a low-level status the third switch $Q_3$ and the fourth switch $Q_4$ are simultaneously shut off. Meanwhile, the first voltage $V_1$ received by the negative terminal of the comparator CMP is also maintained at the constant level. As the third capacitor $C_3$ continuously discharges, the second voltage $V_2$ received by the positive terminal of the comparator CMP is gradually increased. Since the second voltage $V_2$ is still lower than the first voltage $V_1$ from $t=T_{4'}$ to $T_{5'}$, the output terminal of the comparator CMP generates a low-level compensated brightness adjusting signal $V_{d'}$. After $t=T_{5'}$, the third capacitor $C_3$ continuously discharges and the second voltage $V_2$ is greater than the first voltage $V_1$, and thus the output terminal of the comparator CMP generates a high-level compensated brightness adjusting signal $V_{d'}$.

According to the compensated brightness adjusting signal $V_{d'}$, the brightness adjusting circuit 14 generates the control signal $V_c$. As the status of the compensated brightness adjusting signal $V_{d'}$ is changed at $t=T_{1'}$ and $t=T_{5'}$, the status of the control signal $V_c$ is also changed at $t=T_{1'}$ and $t=T_{5'}$ under control of the brightness adjusting circuit 14. In addition, the time period of changing the status of the control signal $V_c$ is longer than the time period of changing the status of the compensated brightness adjusting signal $V_{d'}$ by the brightness adjusting signal converting circuit 142.

As the control signal $V_c$ is changed, the feedback voltage $V_{fb}$ and the output voltage $V_o$ are also altered. If the control circuit 11 of the light source driving circuit 1 is affected by the external environment or the internal components and fails to precisely control operations of the switching circuit 12 according to the feedback voltage $V_{fb}$, the duration of maintaining the output voltage $V_o$ at the high-level state (i.e. $t=T_{2'}$ to $T_{6'}$) is shorter than the duration of maintaining the feedback voltage $V_{fb}$ at the high-level state (i.e. $t=T_{1'}$ to $T_{7'}$).

In a case that the brightness adjusting signal $V_d$ is at a high-level status from $t=T_{1'}$ to $T_{4'}$ for example, a high-level output voltage $V_o$ is outputted from the light source driving circuit 1 to drive illumination of the light-emitting element 9. That is, the brightness adjusting signal $V_d$ at the high-level status indicates the enabling signal. Whereas, in a case that the brightness adjusting signal $V_d$ is at a low-level status, a low-level output voltage $V_o$ is outputted from the light source driving circuit 1 to turn off the light-emitting element 9. That is, the brightness adjusting signal $V_d$ at the low-level status indicates the disabling signal. Since the control circuit 11 of the light source driving circuit 1 is affected by the external environment or the internal components, the output voltage $V_o$ delays the brightness adjusting signal $V_d$ by a delaying time of $(T_{2'}-T_{1'})$.

Please refer to FIG. 6 again. The compensating circuit 16 is used for increasing the duration of the enabling signal of the brightness adjusting signal $V_d$, thereby generating a compensated brightness adjusting signal $V_{d'}$ to the brightness adjusting circuit 14. Although the durations of maintaining the control signal $V_c$ and the feedback voltage $V_{fb}$ at the high-level state are longer than the enabling duration of the brightness adjusting signal $V_d$, the durations of maintaining the output voltage $V_o$ at the high-level state can be equal to the duration of the enabling signal of the brightness adjusting signal $V_d$ by means of the compensating circuit 16. According to the compensated brightness adjusting signal $V_{d'}$, the brightness value of the light-emitting element 9 can be precisely adjusted by the light source driving circuit 1.

Figure 7:
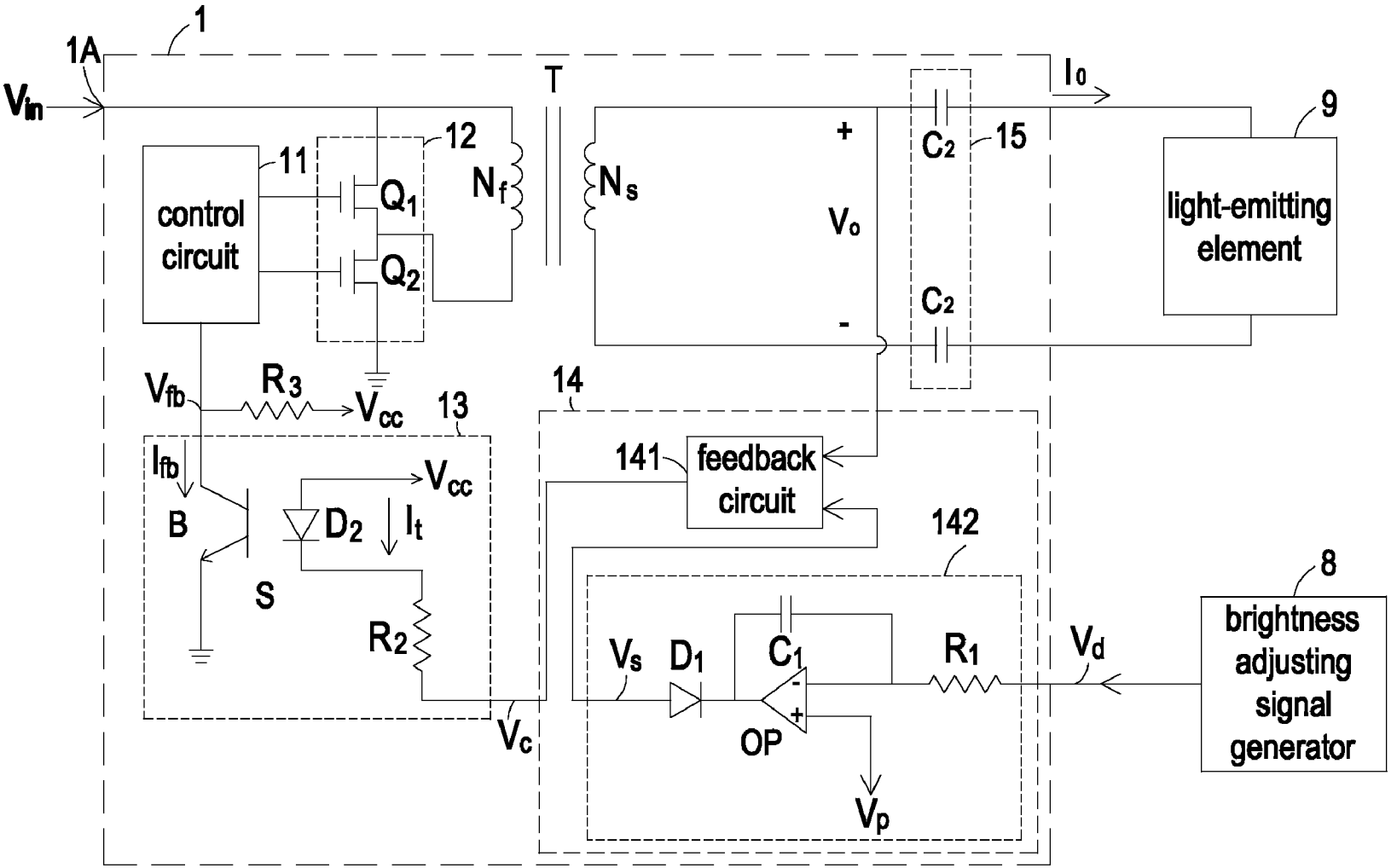
FIG. 7 is a schematic circuit diagram of a light source driving circuit according to a third embodiment of the present invention.

FIG. 7 is a schematic circuit diagram of a light source driving circuit according to a third embodiment of the present invention. Components corresponding to those of the first embodiment are designated by identical numeral references, and detailed description thereof is omitted. In comparison with FIG. 1, the output terminal of the brightness adjusting signal converting circuit 142 is connected to another input terminal of the feedback circuit 141. When the brightness adjusting signal $V_d$ transmitted from the brightness adjusting signal generator 8 is received by the brightness adjusting signal converting circuit 142, the brightness adjusting signal converting circuit 142 will increase the time period of changing the brightness adjusting signal $V_d$, thereby generating a transit signal Vs to the feedback circuit 141. According to the output voltage $V_o$ and the transit signal Vs, the feedback circuit 141 generates the control signal $V_c$. Similarly, the time period of changing the status of the control signal $V_c$ is longer than the time period of changing the status of the brightness adjusting signal $V_d$ by the brightness adjusting signal converting circuit 142. When the light-emitting element 9 is driven to illuminate by the output voltage $V_o$ that is generated by the light source driving circuit 1, the light source scintillation is reduced because the time period of changing the status of the output voltage $V_o$ is increased.

From the above description, the brightness adjusting circuit is isolated from the primary winding assembly of the transformer by an isolator circuit according to the present invention, and thus the light source driving circuit of the present invention has enhanced electrical safety. Moreover, since the time period of changing the status of the brightness adjusting signal is increased by the brightness adjusting circuit, the brightness value of the light-emitting element becomes more stable and the light source scintillation is reduced when the light-emitting element is driven to illuminate.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A light source driving circuit for driving at least one light-emitting element and controlling a brightness value of said light-emitting element according to a brightness adjusting signal, said light source driving circuit comprising:

a transformer comprising a primary winding assembly and a secondary winding assembly, wherein said secondary winding assembly is electrically connected to said light-emitting element;

a switching circuit electrically connected to said primary winding assembly of said transformer;

a control circuit electrically connected to said switching circuit;

a brightness adjusting circuit electrically connected to said secondary winding assembly of said transformer and said light-emitting element for detecting an output voltage and/or an output current outputted from said secondary winding assembly and generating a control signal according to the brightness adjusting signal; and an isolator circuit electrically connected to said brightness adjusting circuit and said control circuit for isolating said primary winding assembly of said transformer from said brightness adjusting circuit, wherein said isolator circuit generates a feedback current according to said control signal and said switching circuit is controlled by said control circuit according to said feedback current, wherein as a status of said brightness adjusting signal is changed, a status of said control signal is changed, and a time period of changing said status of said control signal is longer than a time period of changing said status of said brightness adjusting signal.

2. The light source driving circuit according to claim 1 wherein said light-emitting element includes a cold cathode fluorescent lamp or a light emitting diode.

3. The light source driving circuit according to claim 1 wherein said brightness adjusting signal is generated by a brightness adjusting signal generator.

4. The light source driving circuit according to claim 1 wherein said switching circuit includes a first switch and a second switch, which are connected to said control circuit and alternately conducted or shut off under control of said control circuit.

5. The light source driving circuit according to claim 1 wherein said brightness adjusting circuit comprises:

a feedback circuit electrically connected to said secondary winding assembly of said transformer and said light-emitting element for detecting said output voltage and/or said output current; and a brightness adjusting signal converting circuit connected to said feedback circuit and an output terminal of said brightness adjusting circuit for receiving said brightness adjusting signal and increasing said time period of changing said status of said brightness adjusting signal, wherein said brightness adjusting circuit generates said control signal according to said output voltage and/or said output current received by said feedback circuit and said brightness adjusting signal received by said brightness adjusting signal converting circuit, so that said time period of changing said status of said control signal is adjusted to be longer than said time period of changing said status of said brightness adjusting signal by said brightness adjusting signal converting circuit.

6. The light source driving circuit according to claim 5 wherein said brightness adjusting signal converting circuit includes a signal amplifier, a first capacitor, a first resistor and a first diode, wherein said first resistor receives said brightness adjusting signal and is connected to a negative terminal of said signal amplifier, a positive terminal of said signal amplifier receives a reference voltage, an output terminal of said signal amplifier is connected to a cathode of said first diode, an anode of said first diode is connected to said output terminal of said brightness adjusting circuit, and said first capacitor is connected to said negative terminal and said output terminal of said signal amplifier.

7. The light source driving circuit according to claim 1 wherein said isolator circuit includes a photo coupler and a second resistor, said second resistor is connected to an input terminal of the photo coupler and said brightness adjusting circuit for receiving said control signal from said brightness adjusting circuit, said input terminal of said photo coupler receives a source voltage, and an output terminal of said photo coupler is connected to said control circuit.

8. The light source driving circuit according to claim 1 further comprising a third resistor, wherein said third resistor has an end receiving a source voltage and the other end connected to said control circuit and said isolator circuit, a feedback voltage is generated by said third resistor in response to said feedback current from said isolator circuit, and said control circuit controls operations of said switching circuit according to said feedback voltage.

9. The light source driving circuit according to claim 1 further comprising a fourth resistor, wherein said fourth resistor is connected to said secondary winding assembly of said transformer, said light-emitting element and said brightness adjusting circuit for issuing a detecting voltage to said brightness adjusting circuit according to said output voltage.

10. The light source driving circuit according to claim 1 further comprising a sharing circuit, wherein said sharing circuit is interconnected between said secondary winding assembly of the transformer and said at least one light-emitting element, wherein if said at least one light-emitting element includes multiple light-emitting elements, the currents flowing into all of said multiple light-emitting elements are equalized by said sharing circuit.

11. The light source driving circuit according to claim 1 wherein said brightness adjusting signal includes alternate enabling signal and disabling signal, said light-emitting element is driven to illuminate in response to the enabling signal, and said light-emitting element is turned off in response to the disabling signal.

12. The light source driving circuit according to claim 11 wherein said brightness adjusting circuit comprises:

a feedback circuit electrically connected to said secondary winding assembly of said transformer and said light-emitting element for detecting said output voltage and/or said output current;

a compensating circuit for receiving said brightness adjusting signal and increasing the duration of said enabling signal of said brightness adjusting signal, thereby generating a compensated brightness adjusting signal; and a brightness adjusting signal converting circuit connected to said compensating circuit for receiving said compensated brightness adjusting signal and increasing a time period of changing a status of said compensated brightness adjusting signal, so that said time period of changing said status of said control signal is adjusted to be longer than said time period of changing said status of said compensated brightness adjusting signal and said time period of changing said status of said brightness adjusting signal.

13. The light source driving circuit according to claim 12 wherein said compensating circuit includes a third switch, a fourth switch, a fifth resistor, a sixth resistor, a third capacitor, a filtering circuit and a comparator, wherein said third switch is connected to said fifth resistor, said filtering circuit and a common terminal, said fourth switch is connected to said third capacitor, a positive terminal of said comparator, said sixth resistor and said common terminal, and said third switch and said fourth switch are simultaneously conducted or shut off according to said brightness adjusting signal.

14. The light source driving circuit according to claim 13 wherein said fifth resistor is connected to said third switch, said sixth resistor and said filtering circuit, said sixth resistor is connected to said third capacitor, said fourth switch, said fifth resistor and said positive terminal of said comparator, and both of said fifth resistor and said sixth resistor receive a source voltage.

15. The light source driving circuit according to claim 14 wherein said filtering circuit is connected to said fifth resistor, said third switch, a negative terminal of said comparator and said common terminal.

16. The light source driving circuit according to claim 15 wherein said filtering circuit further includes a seventh resistor and a fourth capacitor, said seventh resistor is connected to said fifth resistor, said third switch, said negative terminal of said comparator and said fourth capacitor, and said fourth capacitor is connected to said seventh resistor, said negative terminal of said comparator and said common terminal.

17. The light source driving circuit according to claim 15 wherein said third capacitor is connected to said positive terminal of said comparator, said sixth resistor, said fourth switch and said common terminal, said source voltage is transmitted to said third capacitor through said sixth resistor to charge said third capacitor when said fourth switch is conducted, and said third capacitor discharges when said fourth switch is shut off.

18. The light source driving circuit according to claim 17 wherein an output terminal of said comparator is connected to an output terminal of said compensating circuit, said negative terminal of said comparator is connected to said filtering circuit, said positive terminal of said comparator is connected to said sixth resistor, said fourth switch and said third capacitor, and said comparator generates said compensated brightness adjusting signal according to a first voltage and a second voltage that are respectively inputted into said negative terminal and said positive terminal of said comparator.

19. The light source driving circuit according to claim 1 wherein said brightness adjusting circuit comprises:

a feedback circuit electrically connected to said secondary winding assembly of said transformer and said light-emitting element for detecting said output voltage and/or said output current; and a brightness adjusting signal converting circuit connected to said feedback circuit for receiving said brightness adjusting signal and increasing said time period of changing said status of said brightness adjusting signal, thereby generating a transit signal to said feedback circuit, wherein said brightness adjusting circuit generates said control signal according to said output voltage and/or said output current received by said feedback circuit and said transit signal, so that said time period of changing said status of said control signal is adjusted to be longer than said time period of changing said status of said brightness adjusting signal by said brightness adjusting signal converting circuit.

* * * * *